US009505579B2

(12) United States Patent
Ishikawa et al.

(10) Patent No.: US 9,505,579 B2
(45) Date of Patent: Nov. 29, 2016

(54) SHEET PROCESSING APPARATUS HAVING POST-PROCESSING SECTION, AND IMAGE FORMING APPARATUS HAVING THE SHEET PROCESSING APPARATUS

(71) Applicant: CANON KABUSHIKI KAISHA, Tokyo (JP)

(72) Inventors: Naoki Ishikawa, Kashiwa (JP); Hitoshi Kato, Toride (JP); Yasuo Fukatsu, Abiko (JP); Taishi Tomii, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/790,104

(22) Filed: Jul. 2, 2015

(65) Prior Publication Data

US 2016/0009518 A1 Jan. 14, 2016

(30) Foreign Application Priority Data

Jul. 10, 2014 (JP) ..... 2014-142306

(51) Int. Cl.

| | |
|---|---|
| ***B65H 29/58*** | (2006.01) |
| ***B65H 31/24*** | (2006.01) |
| ***B65H 43/00*** | (2006.01) |
| ***B65H 29/12*** | (2006.01) |

(52) U.S. Cl.

CPC ..... *B65H 31/24* (2013.01); *B65H 29/125* (2013.01); *B65H 29/58* (2013.01); *B65H 43/00* (2013.01); *B65H 2301/4213* (2013.01); *B65H 2301/42194* (2013.01); *B65H 2403/942* (2013.01); *B65H 2404/632* (2013.01); *B65H 2511/11* (2013.01); *B65H 2515/112* (2013.01); *B65H 2555/13* (2013.01); *B65H 2555/23* (2013.01); *B65H 2801/27* (2013.01)

(58) Field of Classification Search

CPC ..... B65H 31/24; B65H 31/02; B65H 29/58; B65H 29/60; B65H 29/64; B65H 29/6645; B65H 29/6609

See application file for complete search history.

(56) References Cited

U.S. PATENT DOCUMENTS

| | | | | |
|---|---|---|---|---|
| 5,284,333 | A | 2/1994 | Ishikawa | |
| 5,290,021 | A | 3/1994 | Murooka et al. | |
| 5,507,482 | A | 4/1996 | Tenpaku et al. | |
| 6,804,473 | B2 | 10/2004 | Nakamura et al. | |
| 6,826,374 | B2 | 11/2004 | Kato et al. | |
| 6,997,449 | B2 | 2/2006 | Obuchi et al. | |
| 7,050,751 | B2 | 5/2006 | Watanabe et al. | |
| 7,597,324 | B2 | 10/2009 | Obuchi et al. | |
| 7,954,818 | B2 | 6/2011 | Fukatsu et al. | |
| 8,292,285 | B2 * | 10/2012 | Yokoya | B65H 31/36 270/58.01 |
| 8,511,665 | B2 | 8/2013 | Iwata et al. | |
| 9,027,919 | B2 | 5/2015 | Fukusaka et al. | |
| 2013/0032988 | A1 * | 2/2013 | Miyake | B65H 31/34 270/58.08 |
| 2015/0183605 | A1 | 7/2015 | Kato et al. | |

* cited by examiner

*Primary Examiner* — Luis A Gonzalez

(74) *Attorney, Agent, or Firm* — Fitzpatrick, Cella, Harper & Scinto

(57) ABSTRACT

A sheet processing apparatus which is capable of reducing the frequency of switching a convey route. The sheet processing apparatus is provided with a switching unit that switches between a first position at which conveyed sheet is led to a first convey path, and a second position at which conveyed sheet is led to a second convey path. A buffering process of overlaying the conveyed sheet conveyed from a buffer path and another sheet subsequently conveyed by the conveyed unit is performed. The second convey path is used by the buffering process when the conveyed sheet to be received into the buffer path is ejected to the second stacking unit, and the first convey path is used by the buffering process when the conveyed sheet to be received into the buffer path is ejected to the first overlaying unit.

10 Claims, 12 Drawing Sheets

SHEET PROCESSING APPARATUS HAVING POST-PROCESSING SECTION, AND IMAGE FORMING APPARATUS HAVING THE SHEET PROCESSING APPARATUS

BACKGROUND OF THE INVENTION

1. Field of the Invention

The present invention relates to a sheet processing apparatus which processes sheets, and an image forming apparatus having the sheet processing apparatus.

2. Description of the Related Art

Conventionally, a sheet processing apparatus is known which is equipped with a post-processing section adapted to apply post-processing such as stapling to a sheet and the sheet processing apparatus is generally connected to a latter stage of an image forming apparatus. During the post-processing, succeeding sheets cannot be conveyed to the post-processing section, which results in reduced productivity. To avoid this reduction in productivity, a technique is proposed for temporarily holding succeeding sheets on an upstream side of the post-processing section in a convey direction during the post-processing and overlaying a plurality of sheets one on top of another.

According to U.S. Pat. No. 8,511,665, the productivity is maintained as follows: during post-processing of a preceding sheet, the first one of the succeeding sheets is reversed and made to wait in a convey path, and a overlaying process is performed to overlay a sheet conveyed next on the first sheet.

In recent years, types of sheet have diversified and sheet processing apparatuses are expected to accommodate sheets ranging from thick to thin ones. Thin sheets have low rigidity, and so to say, poor strength, and thus when stacked on a stacking tray of a sheet processing apparatus, the thin sheets show reduced stackability. It should be noted that the stackability is a degree of dispersion in stack position of a plurality of sheets in the convey direction of the sheets and in a direction orthogonal to the convey direction, respectively, where the lower the degree of dispersion, the higher the stackability. Thus, a technique is generally known of performing the overlaying process described above and ejecting a plurality of sheets in a overlaid state onto a stacking tray in the case of sheets having poor strength with possibly reduced stackability even when the post-processing is not performed.

The sheet processing apparatus according to U.S. Pat. No. 8,511,665 has an upper ejection slot and a lower ejection slot used to eject sheets received from an image forming apparatus, as well as two convey paths used to convey sheets to the respective ejection slots. One of the convey paths (lower convey path) is led to the post-processing section and further connected to the lower ejection slot on a downstream side of the post-processing section in the convey direction. The other of the convey paths (upper convey path) is connected to the upper ejection slot without through the post-processing section. A convey route is switched to either of the two convey paths depending on the position of a flapper. The overlaying process is carried out using the lower convey path.

However, as described above, to improve the stackability, it is desirable to carry out the overlaying process in the case of the thin sheets even when post-processing is not performed. A plurality of sheets having undergone the overlaying process need to be conveyed to an appropriate output slot depending on whether or not the post-processing is necessary. That is, the sheets needing the post-processing should be conveyed to the lower ejection slot while the sheets not needing the post-processing should be conveyed to the upper ejection slot.

The sheet processing apparatus according to U.S. Pat. No. 8,511,665 performs the overlaying process through switch-back convey using the lower convey path. That is, the sheet conveyed in a reverse direction after once entering the lower convey path is received in a buffer section and then conveyed with a succeeding sheet overlaid thereon. Such a configuration of overlaying the sheets through the switch-back convey needs a flapper switching action in order to switch the convey route, thereby conveying the stacked sheets to the upper ejection slot. For example, if the flapper is initially positioned on a side of the lower ejection slot, it is necessary to drive the flapper to switch the convey route to the upper ejection slot.

Consequently, the flapper switching action occurs whenever the sheet is ejected, and generates noise due to the flapper hammering the convey the path. In particular, when the overlaying process of overlaying a plurality of sheets is repeated during execution of a job, the flapper switching action occurs whenever the overlaying process is performed, thereby increasing the frequency of noise generation.

In these days when noise reduction is expected of apparatus, the frequency of occurrence of the flapper switching noise is desired to be low. However, in particular, small-size sheets generally requires less convey time intervals; accordingly, the convey route switching actions take place frequently, thereby providing a problem of increasing the frequency of occurrence of flapper switching noise.

On the other hand, even if it is necessary to reduce the frequency of occurrence of the flapper switching noise, there has to be avoided a situation in which a sheet will temporarily jump out of an ejection slot in a stage of the overlaying process, which needs to be noted especially in the overlaying process of large-size sheets.

SUMMARY OF THE INVENTION

The present invention provides a sheet processing apparatus which is capable of reducing the frequency of switching a convey route, and an image forming apparatus having the sheet processing apparatus.

According to an aspect of the present invention, there is provided a sheet processing apparatus comprising: a convey unit configured to convey a sheet; a first stacking unit on which the sheet conveyed by the convey unit is stacked through a first convey path; a second stacking unit on which the sheet conveyed by the convey unit is stacked through a second convey path; a switching unit configured to switch between a first position at which the conveyed sheet is led to the first convey path, and a second position at which the conveyed sheet is led to the second convey path; a buffer path, disposed at a location of upstream of the switching unit, into which the conveyed sheet once entering the first convey path or the second convey path and subsequently reversely conveyed is received; and a control unit configured to control the convey unit and the switching unit so as to perform a buffering process of overlaying the conveyed sheet conveyed from the buffer path and another sheet subsequently conveyed by the convey unit, wherein the control unit controls the convey unit and the switching unit such that the second convey path is used by the buffering process when the conveyed sheets to be received into the buffer path is ejected to the second stacking unit, and that the first convey path is used by the buffering process when the conveyed sheet to be received into the buffer path is ejected to the first stacking unit.

According to the present invention, it is possible to reduce the frequency of switching the convey route.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 1:
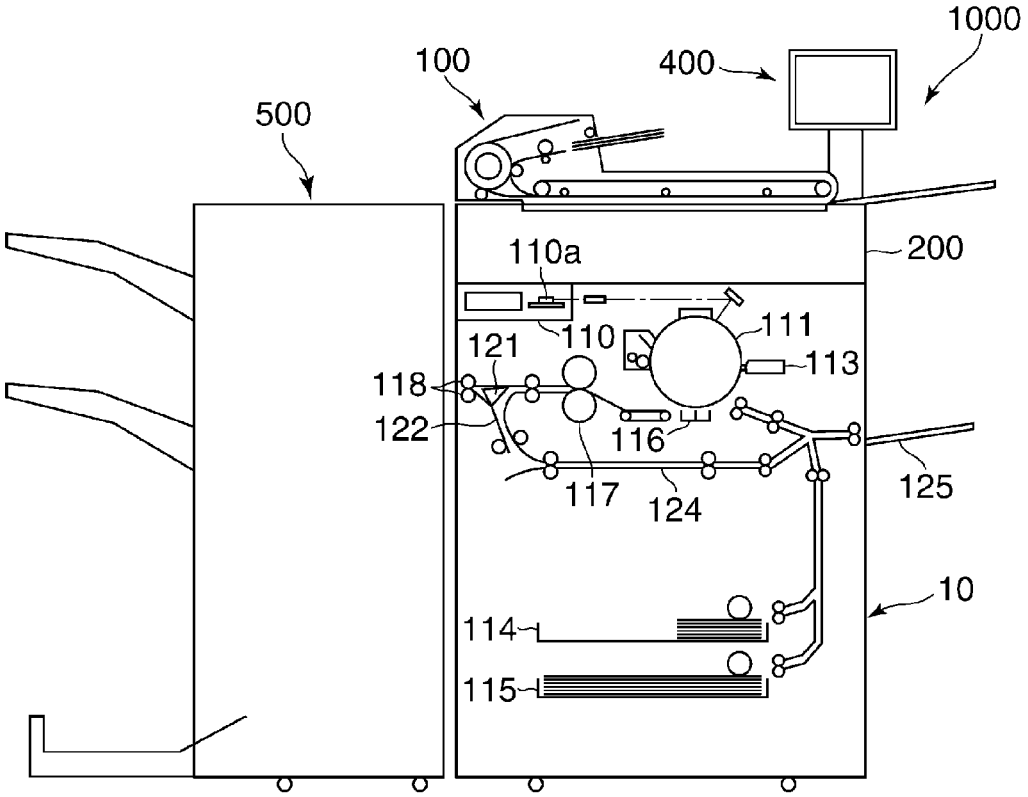
FIG. 1 is a sectional view of an image forming system, including a sheet processing apparatus, according to an embodiment of the present invention.

FIG. 1 is a sectional view of an image forming system including a sheet processing apparatus according to an embodiment of the present invention.

In FIG. 1, the image forming system 1000 includes an image forming apparatus 10, an image reader 200, a document feeder 100, an operation display 400, and a sheet processing apparatus 500. The sheet processing apparatus 500 is connected to a latter stage (sheet ejection side) of the image forming apparatus 10.

An exposure control section 110 of the image forming apparatus 10 modulates a laser beam based on an input video signal and outputs the modulated laser beam, which is then irradiated on a photosensitive drum 111 while being scanned by a polygon mirror 110*a*. An electrostatic latent image corresponding to the scanned laser beam is formed on the photosensitive drum 111. The electrostatic latent image on the photosensitive drum 111 is visualized into a developer image by a developer supplied from a developing device 113.

Also, timed with the start of laser beam irradiation, a sheet is supplied from a cassette 114 or 115, a manual sheet feed section 125, or a double-side printing convey path 124 and supplied to between the photosensitive drum 111 and a transfer section 116. The developer image formed on the photosensitive drum 111 is transferred onto the paper supplied to the transfer section 116.

The sheet with the developer image transferred thereto is conveyed to a fixing section 117, which then fixes the developer image onto the sheet by thermo-compressing the sheet. The sheet which has passed the fixing section 117 is ejected outward from the image forming apparatus 10 through a flapper 121 and an ejection roller pair 118.

When the sheet is ejected with an image forming surface down (face-down), the image forming apparatus 10 temporarily leads the sheet, which has passed the fixing section 117, into a reverse path 122 by a switching action of the flapper 121. Then, after a rear edge of the sheet has passed the flapper 121, the image forming apparatus 10 switches back the sheet and then ejects the sheet out of the image forming apparatus 10 via the ejection roller air 118. This sheet ejection form is referred to as "the reversed sheet ejection".

Also, when a hard sheet such as an OHP sheet is supplied from the manual sheet feed section 125, the image forming apparatus 10 ejects the sheet with the image forming surface up (face-up) via the ejection roller pair 118 without leading the sheet to the reverse path 122.

Furthermore, when the double-side printing is set of specifying images to be formed on both sides of paper, the image forming apparatus 10 leads the sheet to the reverse path 122 by a switching action of the flapper 121 and then conveys the sheet to the double-side printing convey path 124. Then, the image forming apparatus 10 performs control so that the paper led to the double-side printing convey path 124 will be supplied to between the photosensitive drum 111 and transfer section 116 again with the above-mentioned timing.

Figure 2:
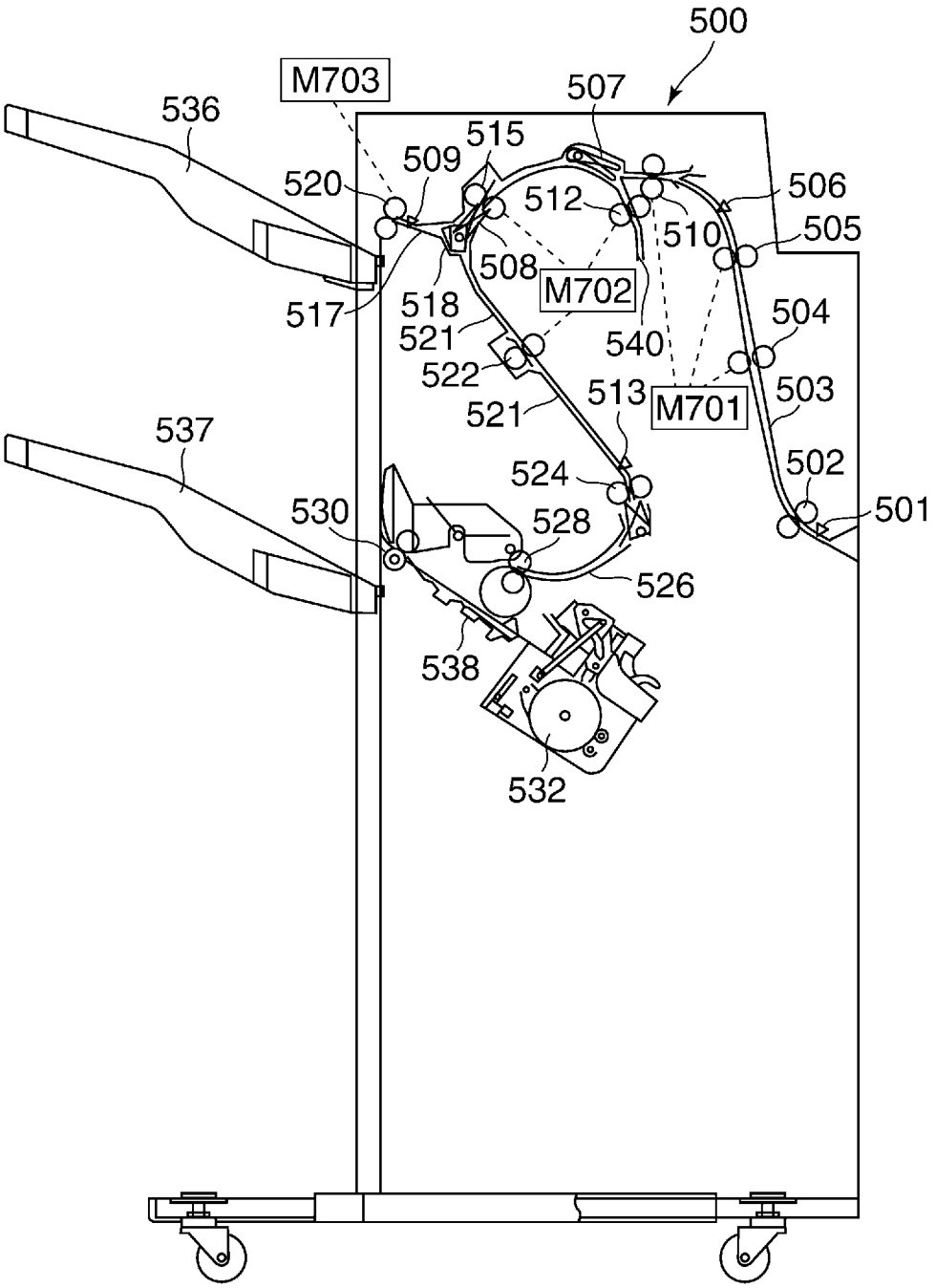
FIG. 2 is a sectional view of the sheet processing apparatus in FIG. 1.

FIG. 2 is a sectional view of the sheet processing apparatus 500 in FIG. 1.

In FIG. 2, the sheet processing apparatus 500 accepts sheets ejected from the image forming apparatus 10, performs necessary processes on the sheets and ejects the sheets out of the apparatus, in which two trays, an upper tray 536 and a lower tray 537, are disposed as "the stacking unit" on which the ejected sheets are stacked.

The sheets ejected from the image forming apparatus 10 are delivered to an inlet roller pair 502 of the sheet processing apparatus 500. In so doing, a sheet delivery timing is also detected by an inlet sensor 501 at the same time. The sheet conveyed by the inlet roller pair 502 is conveyed through a convey path 503 by a first convey roller pair 504, a second convey roller pair 505, and a third convey roller pair 510. The first, second, and third convey roller pairs 504, 505, and 510 are driven by a conveying motor M701. Also, a path sensor 506 is disposed between the second convey roller pair 505 and third convey roller pair 510.

A buffer path switching flapper 507 is disposed between the third convey roller pair 510 and a second buffer roller pair 515 disposed at a location downstream thereof. Also, an upper path switching flapper 518 as a switching unit is disposed at a location downstream of the second buffer roller pair 515, where a convey route branches into an upper ejection path 517 (first convey path) and a lower ejection path 521 (second convey path). The lower ejection path 521 is longer than the upper ejection path 517.

The buffer path switching flapper 507 (hereinafter sometimes abbreviated to "the buffer flapper 507") is driven by a buffer solenoid SL801 to displace the flapper position (see FIG. 3). The upper path switching flapper 518 (hereinafter sometimes abbreviated to "the upper path flapper 518") is driven by an upper ejection solenoid SL802 to displace the flapper position (see FIG. 3).

The sheet conveyed through the buffer flapper 507 by the second buffer roller pair 515 is detected by a buffer sensor 508 disposed at a location downstream of the second buffer roller pair 515.

When the sheet is ejected onto the upper tray 536, the upper path flapper 518 is located at a position ("the first position" described later) where the sheet is led to the upper ejection path 517 connected to the upper tray 536. The sheet is led to the upper ejection path 517, and then ejected onto the upper tray 536 through an upper ejection sensor 509 by the upper ejection roller pair 520. The upper ejection roller pair 520 is driven by an ejection motor M703.

When the sheet is not ejected onto the upper tray 536, the upper path flapper 518 is located at a position ("the second position" described later) where the sheet is led to the lower ejection path 521. The sheet conveyed through the buffer flapper 507 by the second buffer roller pair 515 is led to the lower ejection path 521 and then passes through the paths in sequence by a third buffer roller pair 522 and the first lower ejection roller pair 524. A lower path sensor 513 is disposed between the third buffer roller pair 522 and the first lower ejection roller pair 524.

A buffer path 540 is connected to a convey path in the vicinity of the buffer flapper 507 at a location upstream of the upper path flapper 518. In a sheet overlaying process described later, the sheet is conveyed in a reverse direction after once entering the upper ejection path 517 or the lower ejection path 521 at its front edge and passing the buffer flapper 507 at its rear edge, and subsequently is received in the buffer path 540. The buffer flapper 507 is switched between a position at which the sheet is conveyed through the first, second, and third convey roller pairs 504, 505, and 510 and a position at which the sheet is led to the buffer path 540.

A first buffer roller pair 512 is disposed on the buffer path 540. The first buffer roller pair 512, the second buffer roller pair 515, and the third buffer roller pair 522 are driven by a buffer motor M702. The sheet overlaying process using the buffer path 540 will be described later.

The sheet conveyed to the first lower ejection roller pair 524 is conveyed to a bundle convey path 526. A plurality of sheets ejected onto an intermediate processing tray 538 by a second lower ejection roller pair 528 are aligned on the intermediate processing tray 538. Subsequently, the aligned sheets are stapled, as required, by a stapler 532 serving as a post-processing section, and then ejected as a bundle of sheets onto the lower tray 537 by a bundle ejection roller pair 530.

The conveying motor M701, the buffer motor M702, and the ejection motor M703 are constructed of pulse motors, and an amount of advance of each motor is controlled by the number of drive pulses.

Figure 3:
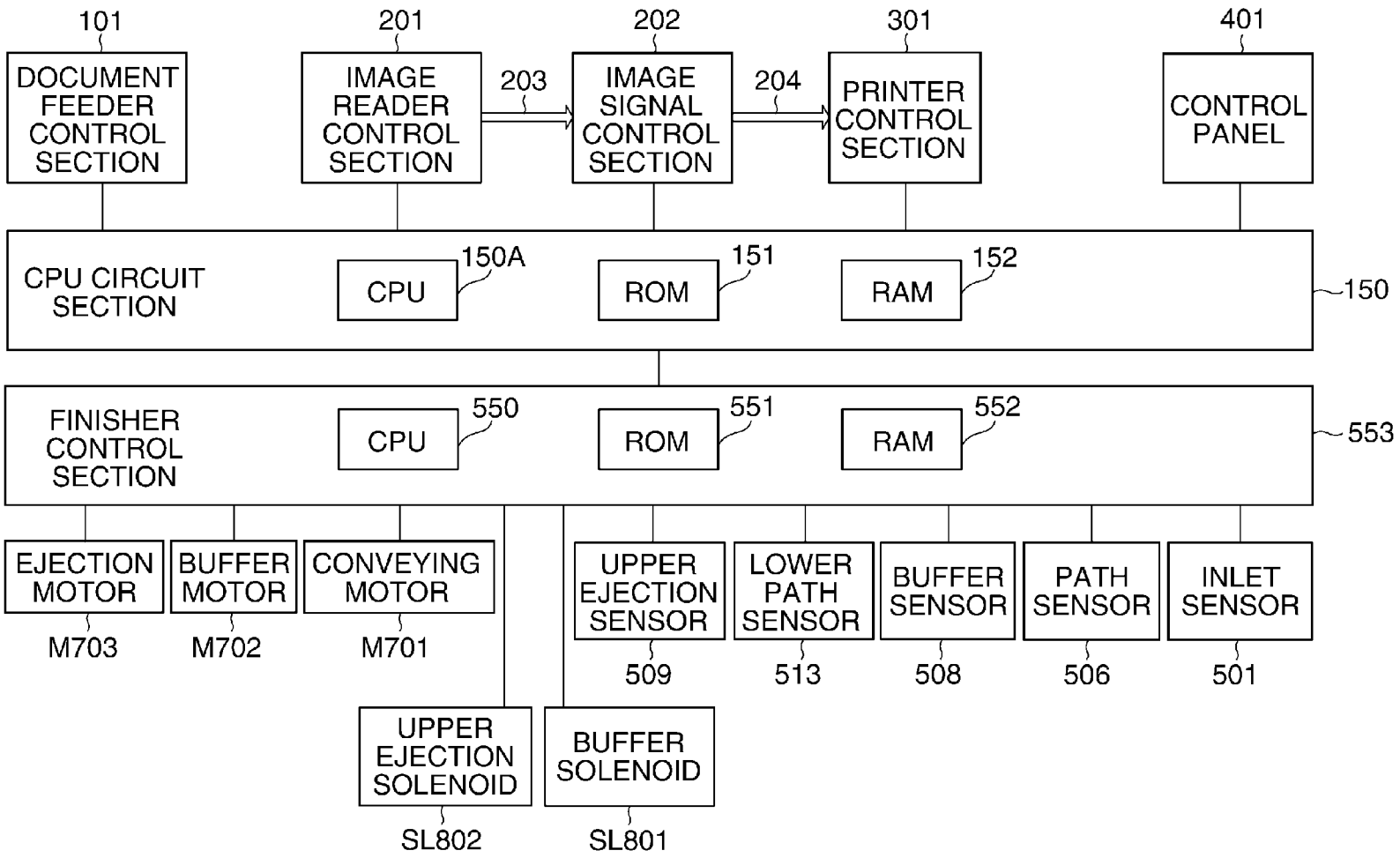
FIG. 3 is a block diagram showing a control system of the image forming system in FIG. 1.

FIG. 3 is a block diagram showing a control system of the image forming system 1000 in FIG. 1.

In FIG. 3, the image forming apparatus 10 includes a CPU circuit section 150 adapted to control the entire image forming apparatus 10. The CPU circuit section 150 has a CPU 150A, a ROM 151, and a RAM 152 built-in and controls respective blocks 101, 201, 202, 301, 401, and 553 based on a control program stored in the ROM 151. The RAM 152 is used as a work area to temporarily hold control data.

The document feeder control section 101 controls driving of the document feeder 100 on instructions from the CPU circuit section 150. The image reader control section 201 controls driving of the image reader 200 and transfers an image signal to an image signal control section 202 via an image bus 203. The image signal control section 202 applies various processes to the image signal and outputs the resulting image signal as a video signal to a printer control section 301 via an image bus 204. The printer control section 301 drives the exposure control section 110 (see FIG. 1) based on the video signal received from the image signal control section 202. The control panel 401 outputs a key signal corresponding to operation of each key on the operation display 400 to the CPU circuit section 150 and causes a display section of the operation display 400 to present a display on instructions from the CPU circuit section 150.

A finisher control section 553 is mounted on the sheet processing apparatus 500 and controls driving of the entire sheet processing apparatus 500. The finisher control section 553 includes a CPU 550, a ROM 551, a RAM 552, and the like. The finisher control section 553 communicates with the CPU circuit section 150 via a communication IC (not shown) and controls the sheet processing apparatus 500 by executing various programs stored in the ROM 551, on instructions from the CPU circuit section 150.

Also, the finisher control section 553 detects status of various sensors including the inlet sensor 501, the path sensor 506, the buffer sensor 508, the lower path sensor 513, and the upper ejection sensor 509 as well as other sensors which are not shown. The finisher control section 553 controls driving of various drive sections including the conveying motor M701, the buffer motor M702, and the ejection motor M703 as well as other drive sections which are not shown. These drive sections further include the buffer solenoid SL801 and the upper ejection solenoid SL802. These various drive sections and various rollers function in association with each other as a convey unit adapted to convey sheets.

With reference to FIGS. 4A to 6E, a description will be given of lower sheet ejection processing of the sheet processing apparatus 500 buffering a plurality of sheets and ejecting the sheets onto the lower tray 537 and upper sheet ejection processing of ejecting the sheets onto the upper tray 536.

FIGS. 4A to 4E are views which are useful in explaining the lower sheet ejection processing performed by the sheet processing apparatus 500 with two A4-size sheets (e.g., small-size sheets) overlaid.

Figure 4A:
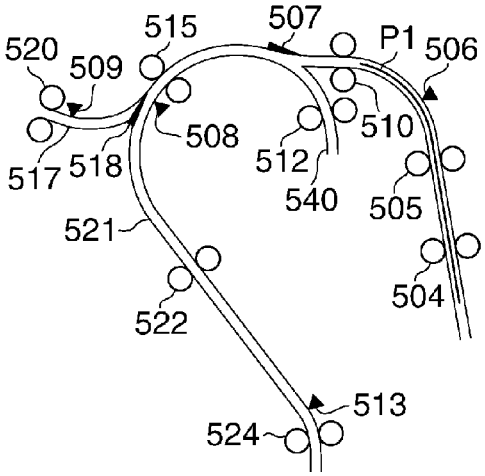
FIGS. 4A to 4E are views which are useful in explaining lower sheet ejection processing performed with two A4-size sheets overlaid.
Figure 4B:
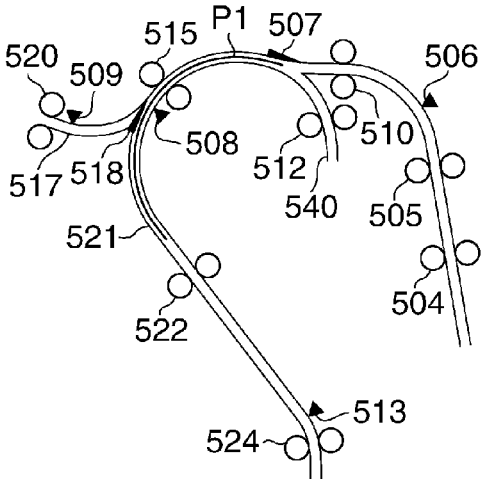
Figure 4C:
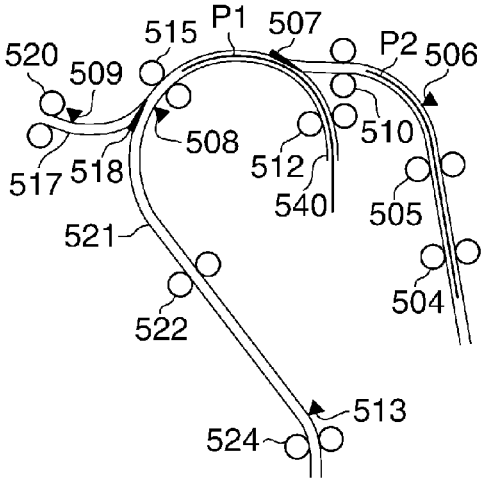

Referring to FIGS. 4A to 4E, the buffer flapper 507 is located, in an initial state (OFF state) in which no driving force is received from the buffer solenoid SL801, at a "conveying position" (as shown in FIG. 4A) where sheets are conveyed downstream by the first, second, and third convey roller pairs 504, 505, and 510. When driven upon actuation of the buffer solenoid SL801, the buffer flapper 507 switches to a "buffering position" (as shown in FIG. 4C) where the sheet conveyed in the reverse direction is led to the buffer path 540. In this case, the convey path from the buffer flapper 507 to the second buffer roller pair 515 is communicated with the buffer path 540.

Figure 5A:
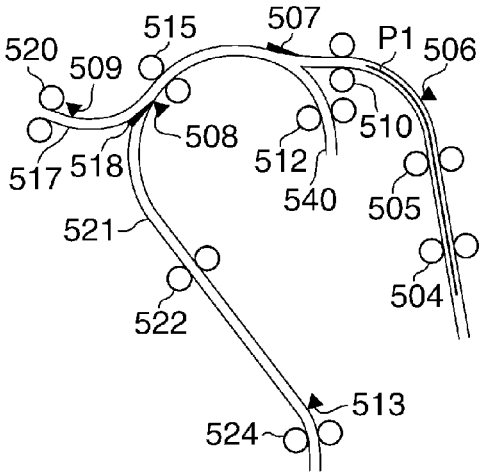
FIGS. 5A to 5E are views which are useful in explaining upper sheet ejection processing performed with two A4-size sheets overlaid.

Also, the upper path flapper 518 is located, in an initial state (OFF state) in which no driving force is received from the upper ejection solenoid SL802, at a position (second position) (as shown in FIG. 4A) where the sheet is led to the lower ejection path 521. When driven upon actuation of the upper ejection solenoid SL802, the upper path flapper 518 switches to a position (first position) (as shown in FIG. 5A) where the sheet is led to the upper ejection path 517.

In a job, conditions related to post-processing are specified for a plurality of sheets to be processed, including: whether or not post-processing is necessary, details of the post-processing, and whether the sheets are subjected to the lower sheet ejection processing or to the upper sheet ejection processing. Just before the start of the job, the buffer flapper 507 and the upper path flapper 518 are in the initial state.

When the sheet processing apparatus 500 performs the lower sheet ejection processing with two A4-size sheets overlaid, a first sheet P1 is firstly conveyed by the first convey roller pair 504 and the second convey roller pair 505 (FIG. 4A). When the sheet P1 passes the buffer flapper 507 located at the conveying position and then the second buffer roller pair 515, and a downstream side edge (front edge of the sheet) of the sheet P1 in a sheet convey direction reaches the buffer sensor 508, the buffer sensor 508 turns on (presence of sheet).

When the buffer sensor 508 turns on before the sheet P1 is conveyed by a predetermined distance, the driving of the buffer motor M702 stops, thereby stopping the buffer roller pairs 515 and 522 (FIG. 4B). In this regard, the predetermined distance has a length enough for an upstream side edge of the sheet P1 (rear edge of the sheet) in the sheet convey direction to fully pass the buffer flapper 507.

Next, when the buffer flapper 507 switches to the buffering position and the buffer motor M702 starts reverse rotation after a lapse of a predetermined time from when having stopped, the sheet P1 is conveyed to the buffer path 540 and is further conveyed by the first buffer roller pair 512. Subsequently, when the buffer sensor 508 turns off (no sheet) before the sheet P1 is conveyed by a predetermined distance, the driving of the buffer motor M702 stops. Consequently, the first buffer roller pair 512 stops to thereby temporarily stop conveying the sheet P1 with the sheet P1 pinched by the first buffer roller pair 512 (FIG. 4C).

Figure 4D:
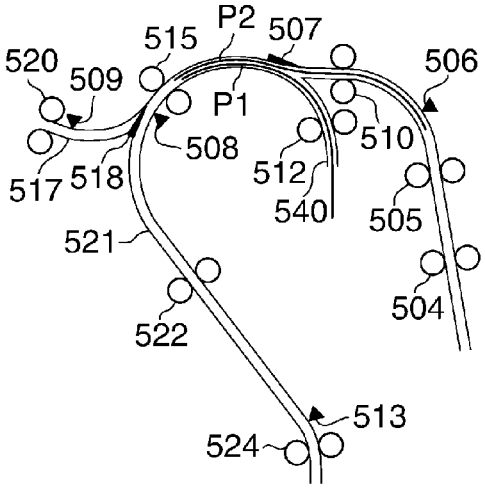

As the first buffer roller pair 512 stops, the buffer flapper 507 switches to the conveying position. Then, a front edge of the second sheet P2 arrives at the path sensor 506, and the path sensor 506 turns on (presence of sheet). After a lapse of a predetermined time therefrom, the buffer motor M702 comes into operation, thereby causing the first buffer roller pair 512 to start normal rotation while pinching the sheet P1, which allows the sheet P1 and the sheet P2 to be consequently overlaid and conveyed downstream (FIG. 4D).

Figure 4E:
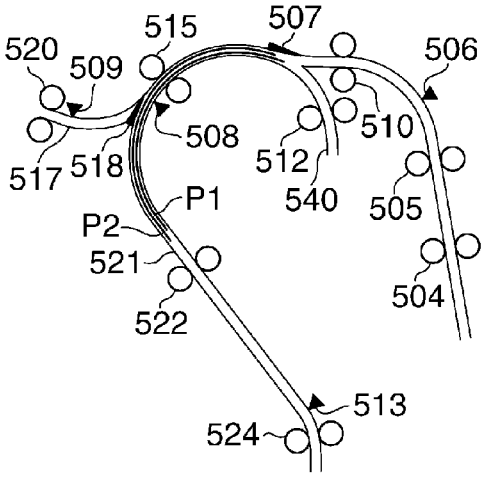

Next, a sheet bunch made up of the sheets P1 and P2 overlaid is conveyed by the second buffer roller pair 515, and when the front edge of the sheet bunch arrives at the buffer sensor 508, the buffer sensor 508 turns on (presence of sheet). The sheet bunch is further conveyed downstream by the third buffer roller pair 522 and the first lower ejection roller pair 524 (FIG. 4E). The conveyed sheet bunch is loaded onto an intermediate processing tray 538.

Subsequently, the sheets P1 and P2 are aligned on the intermediate processing tray 538, stapled by a stapler 532 as required, and then ejected onto the lower tray 537 by the bundle ejection roller pair 530.

Large-size (e.g., A3-size) sheets are subjected to a sheet overlaying process by a similar operation and the sheets overlaid are ejected onto the lower tray 537 via the intermediate processing tray 538.

The sheet overlaying process (hereinafter sometimes referred to as "the overlaying process" or "the buffering process") is to overlay a plurality of sheets, as described above, on the buffer path 540. The finisher control section 553 controls the switching actions of the upper path flapper 518 and the buffer flapper 507 while controlling the sheet convey, and hence functions as a control unit adapted to perform the overlaying process. It should be noted that, in the overlaying process, the front edge of the sheet needs to once enter the upper ejection path 517 or the lower ejection path 521, involving the use of the upper ejection path 517 or the lower ejection path 521 in addition to the buffer path 540.

In the example of FIGS. 4A to 4E, the sheet processing apparatus 500 uses, when performing the lower sheet ejection processing, the lower ejection path 521 connected to the lower tray 537 in the overlaying process. The upper path flapper 518 does not need switching before and after the overlaying. Thus, after a job has been started, from before the start of sheet stacking until the last sheet passes through the upper path flapper 518, the upper path flapper 518 does not need to be driven, and hence is always located at the second position which is an initial position, which prevents, during the execution of a job, switching noise of the upper path flapper 518 from being generated.

Figure 7:
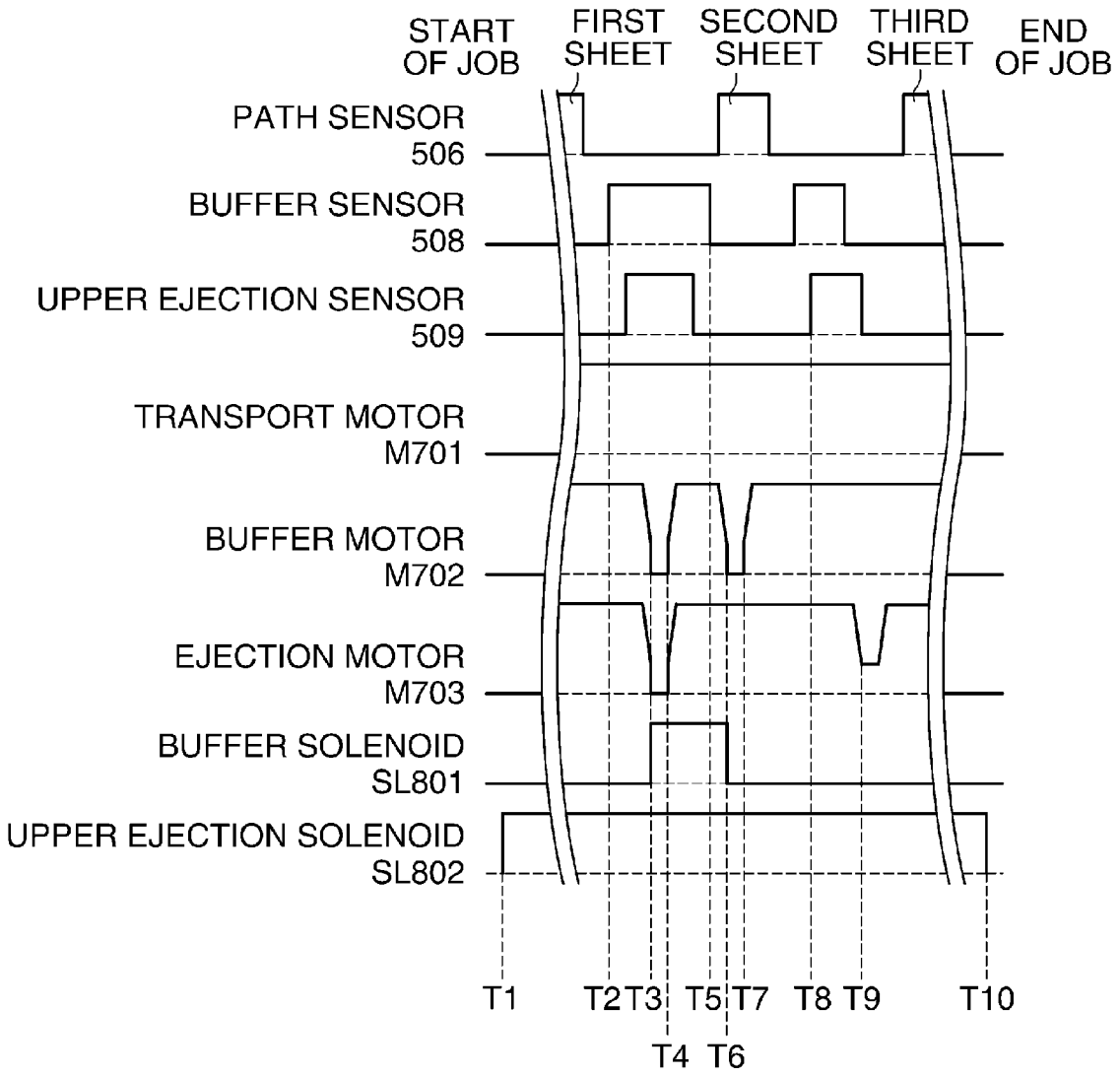
FIG. 7 is a timing chart of the upper sheet ejection processing performed with two A4-size sheets overlaid.
Figure 11:
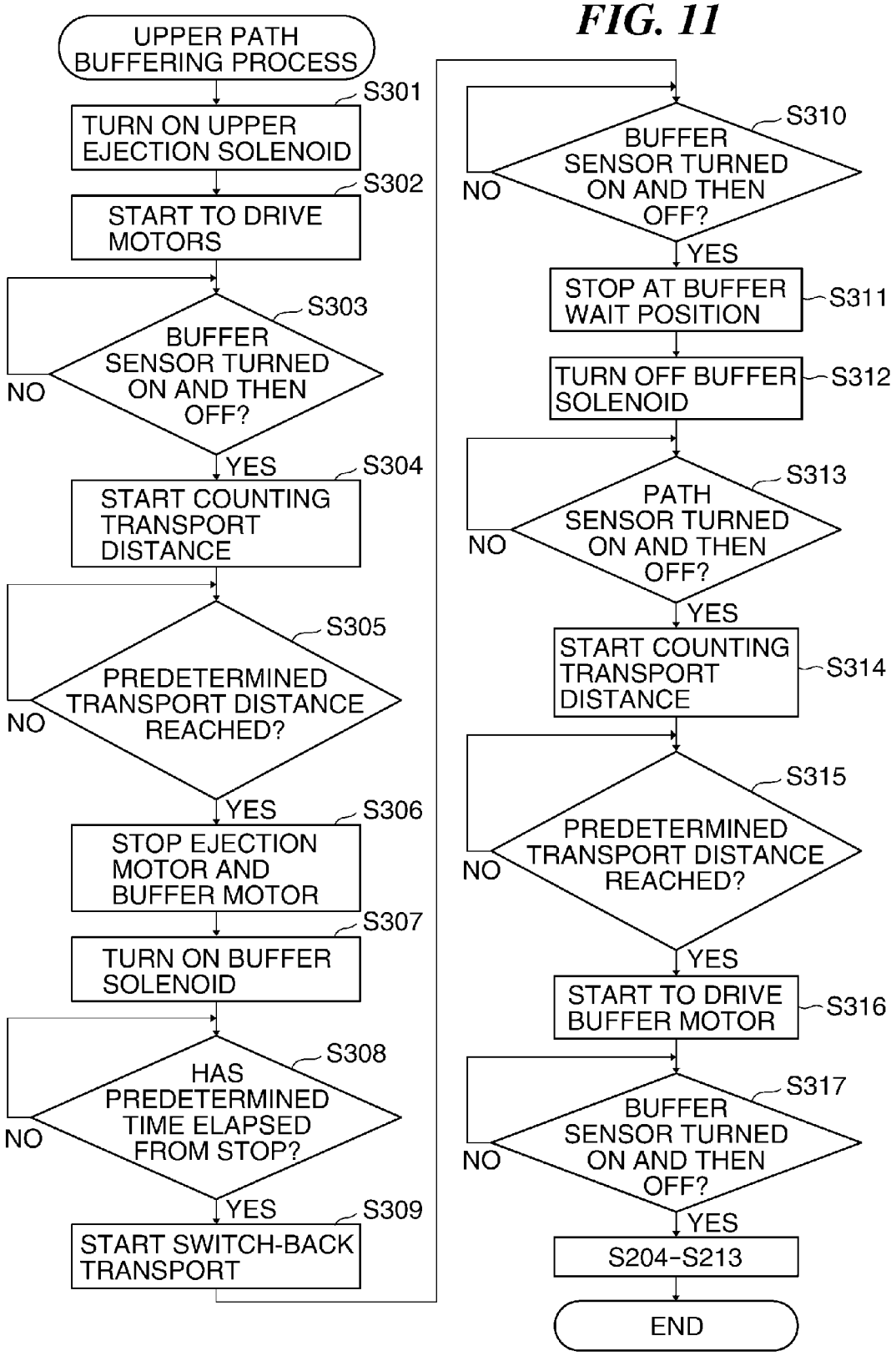
FIG. 11 is a flowchart showing the procedure of an upper path buffering process that is performed at step S106 in FIG. 9.

FIGS. 5A to 5E views which are useful in explaining the upper sheet ejection processing performed by the sheet processing apparatus 500 with two A4-size sheets (e.g., small-size sheets) overlaid, details of which will also be described in FIGS. 7 and 11.

When the sheet processing apparatus 500 performs the upper sheet ejection processing, the upper ejection solenoid SL802 is turned on and the upper path flapper 518 is switched to the first position (FIG. 5A) before the sheet convey and the overlaying process. The first sheet P1 is conveyed by the first convey roller pair 504 and the second convey roller pair 505.

After the sheet P1 passes the buffer flapper 507 located at the conveying position and then the second buffer roller pair 515, when the front edge of the sheet P1 is detected by the buffer sensor 508, the buffer sensor 508 turns on (presence of sheet). Since the upper path flapper 518 is located at the first position, the conveyed sheet P1 is led to the upper ejection path 517.

Figure 5B:
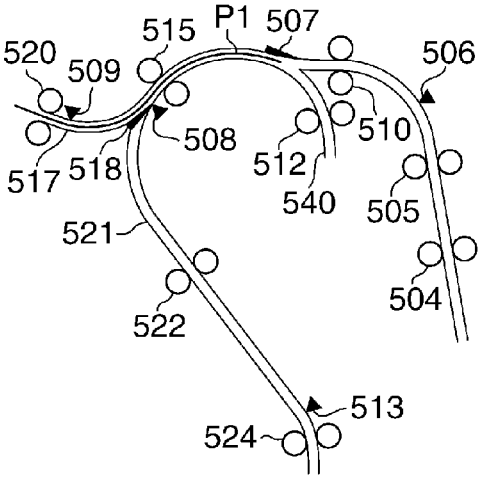

After the buffer sensor 508 turns on, when the sheet P1 is conveyed by a predetermined distance D1, the driving of the buffer motor M702 and the ejection motor M703 stops, thereby stopping the second buffer roller pair 515 and the upper ejection roller pair 520 (FIG. 5B). The predetermined distance D1 is set such that the front edge of the A4-size sheet does not jump out onto the upper tray 536 when the sheet P1 stops in the state of FIG. 5B.

Figure 5C:
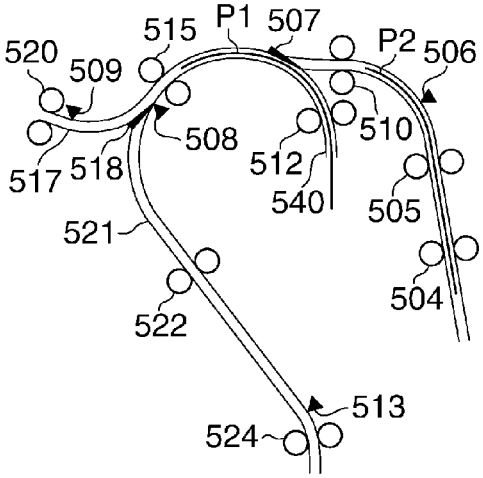

Next, the buffer flapper 507 switches to the buffering position, and each of the buffer motor M702 and the ejection motor M703 starts reverse rotation direction by a predetermined time t1 from when having stopped. Consequently, the sheet P1 is conveyed to the buffer path 540 and is further conveyed by the first buffer roller pair 512. Subsequently, after the buffer sensor 508 turns off (no sheet), when the sheet P1 is conveyed by a predetermined distance D2, the driving of the buffer motor M702 stops. Consequently, the first buffer roller pair 512 stops to thereby temporarily stop conveying the sheet P1 with the sheet P1 pinched by the first buffer roller pair 512 (FIG. 5C).

Figure 5D:
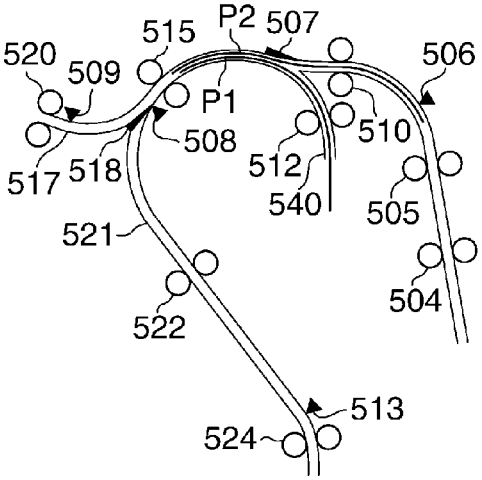

As the first buffer roller pair 512 stops, the buffer flapper 507 switches to the conveying position, and then the path sensor 506 detects the front edge of the second sheet P2 to thereby turn on (presence of sheet). As the buffer motor M702 comes into operation after the sheet P2 is conveyed by a predetermined distance D3 therefrom, the first buffer roller pair 512 starts normal rotation while pinching the sheet P1, and hence the sheet P1 and the sheet P2 are overlaid and conveyed downstream (FIG. 5D).

A sheet bunch made up of the sheets P1 and P2 overlaid is conveyed by the second buffer roller pair 515, and when the front edge of the sheet bunch arrives at the buffer sensor 508, the buffer sensor 508 turns on (presence of sheet). Since the upper path flapper 518 is still located at the first position, the conveyed sheet bunch is led to the upper ejection path 517, and subsequently further conveyed downstream by the upper ejection roller pair 520 (FIG. 5E), followed by ejection onto the upper tray 536.

In the example of FIGS. 5A to 5E, the sheet processing apparatus 500 uses, when performing the upper sheet ejection processing, the upper ejection path 517 connected to the upper tray 536 in the overlaying process. The upper path flapper 518 is located at the first position during the overlaying process. Even if the overlaying process and the sheet ejection process are performed multiple times in a single job, there is no need to switch the upper path flapper 518 whenever the processes are performed. Thus, after the job is started, from before the start of the overlaying process until the last sheet passes through the upper path flapper 518, the upper path flapper 518 may be maintained at the first position. The upper path flapper 518 has only to be switched just twice, at the start of the job and at the end of the job, which reduces the frequency of occurrence of operating noise during execution of the job except for the start and the end of the job.

Figure 8:
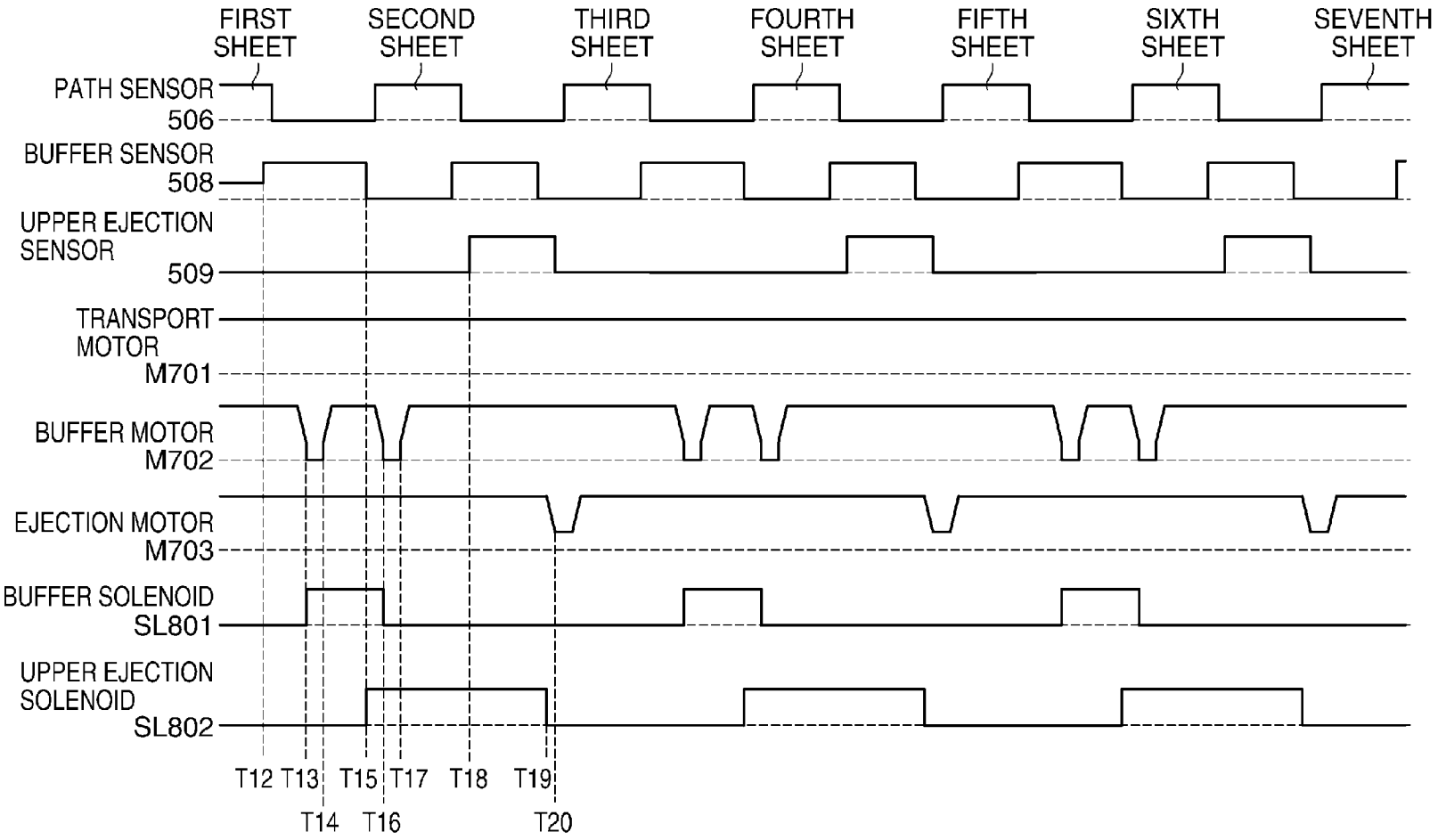
FIG. 8 is a timing chart of the upper sheet ejection processing performed with two A3-size sheets overlaid.
Figure 12:
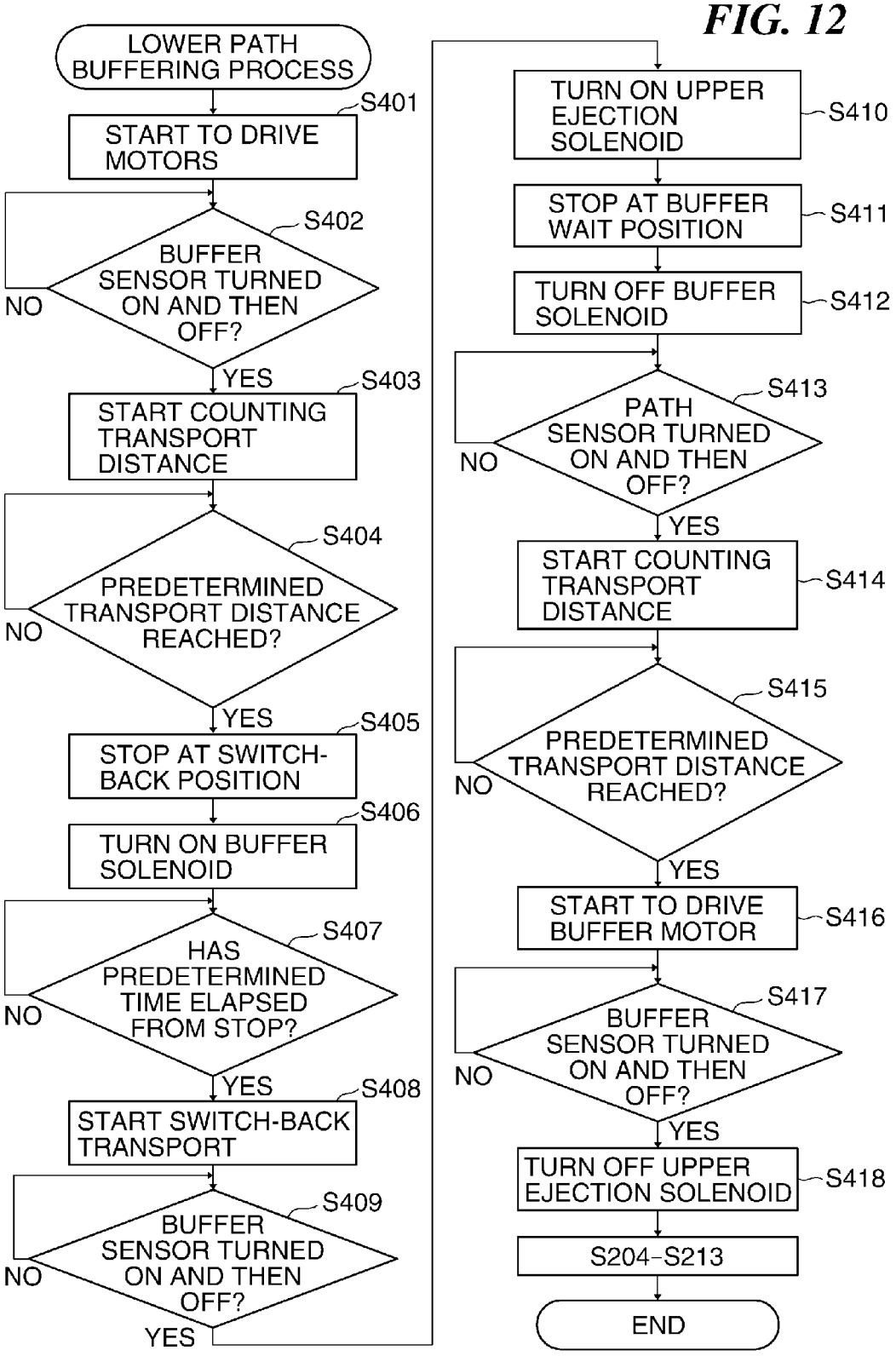
FIG. 12 is a flowchart showing the procedure of a lower path buffering process that is performed at step of S107 in FIG. 9.

FIGS. 6A to 6E are views which are useful in explaining the upper sheet ejection processing performed by the sheet processing apparatus 500 with two A3-size sheets (e.g., large-size sheets) overlaid, details of which will also be described in FIGS. 8 and 12.

Figure 6A:
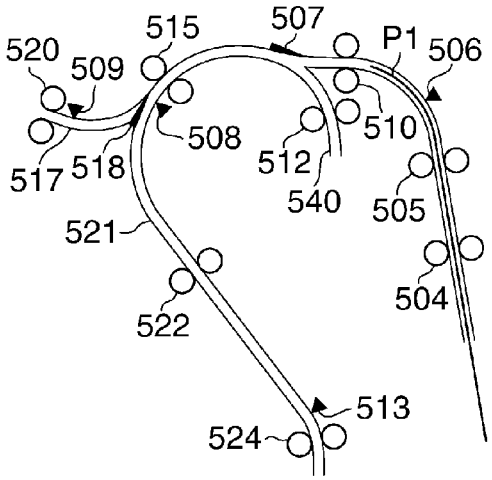
FIGS. 6A to 6E are view which are useful in explaining upper sheet ejection processing performed with two A3-size sheets overlaid.

Firstly, the first sheet P1 is conveyed by the first convey roller pair 504 and the second convey roller pair 505 (FIG. 6A). After the sheet P1 passes the buffer flapper 507 located at the conveying position and then the second buffer roller pair 515, and further when the front edge of the sheet reaches the buffer sensor 508, the buffer sensor 508 turns on (presence of sheet). Since the upper path flapper 518 is located at the second position which is the initial position, the conveyed sheet P1 is led to the lower ejection path 521.

Figure 6B:
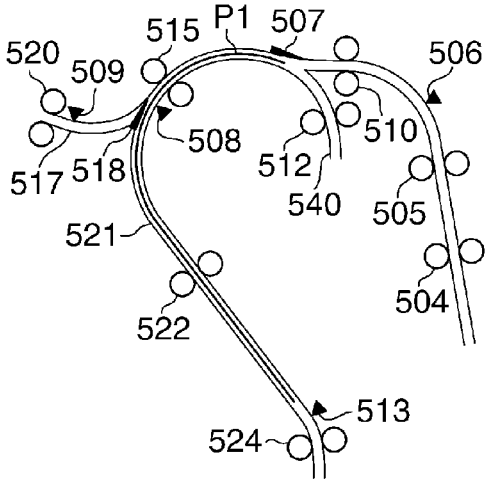

After the buffer sensor 508 turns on, when the sheet P1 is conveyed by a predetermined distance D11, the driving of the buffer motor M702 stops, thereby stopping the buffer roller pairs 515 and 522 (FIG. 6B). In this regard, the predetermined distance D11 has a length enough for the rear edge of the A3-size sheet P1 to fully pass through the buffer flapper 507.

Figure 6C:
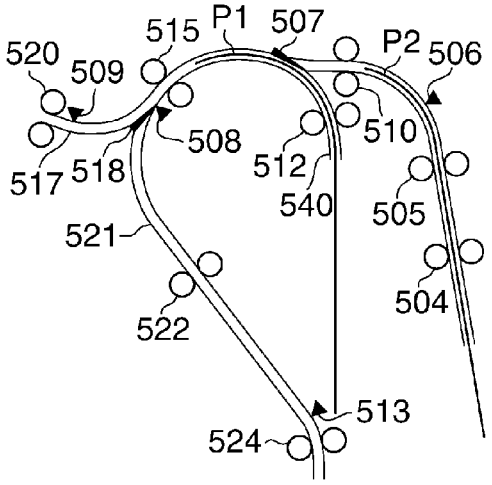

Next, the buffer flapper 507 switches to the buffering position, and when the buffer motor M702 starts reverse rotation after a lapse of a predetermined time t11 from when having stopped, the sheet P1 is conveyed to the buffer path 540 and further conveyed by the first buffer roller pair 512. Subsequently, when the buffer sensor 508 turns off (no sheet), the upper path flapper 518 is switched to the first position. After the buffer sensor 508 turns off (no sheet), when the sheet P1 is conveyed by a predetermined distance D12, the driving of the buffer motor M702 stops. Consequently, the first buffer roller pair 512 stops to thereby temporarily stop conveying the sheet P1 with the sheet P1 pinched by the first buffer roller pair 512 (FIG. 6C).

Figure 6D:
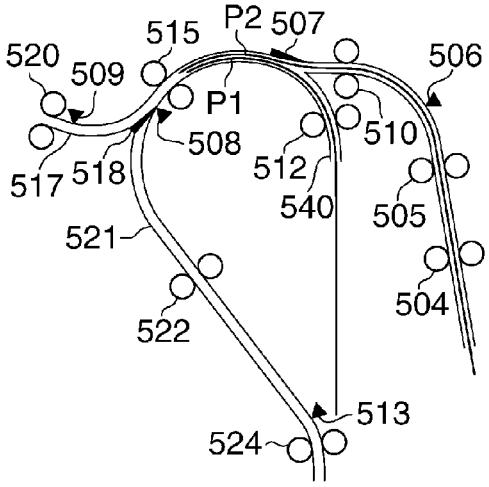

As the first buffer roller pair 512 stops, the buffer flapper 507 switches to the conveying position. Then, the front edge of the second sheet P2 arrives at the path sensor 506, and the path sensor 506 turns on (presence of sheet). After the sheet is conveyed a predetermined distance D13 therefrom, the buffer motor M702 comes into operation, thereby causing the first buffer roller pair 512 to start normal rotation while pinching the sheet P1, which allows the sheet P1 and the sheet P2 to be consequently overlaid and conveyed downstream (FIG. 6D).

Next, a sheet bunch made up of the sheets P1 and P2 overlaid is conveyed by the second buffer roller pair 515, and when the front edge of the sheet bunch arrives at the buffer sensor 508, the buffer sensor 508 turns on (presence of sheet). Since the upper path flapper 518 is located at the first position, the conveyed sheet bunch is led to the upper ejection path 517. Then, the sheet bunch is further conveyed downstream by the upper ejection roller pair 520 (FIG. 6E) and ejected onto the upper tray 536. After the buffer sensor 508 turns off, the upper path flapper 518 returns to the first position which is an initial position (not shown).

Suppose the sheet processing apparatus 500 buffers large-size sheets using the upper ejection path 517 as in the case of small-size sheets, the front edges of the sheets might jump out of the apparatus because of a relatively short path length of the upper ejection path 517. This might cause the sheet already stacked on the upper tray 536 to be pushed out, resulting in reduced stackability. On the other hand, if the convey speed at which the front edge of the sheet jumps out of the apparatus is set low to keep the stackability up, the productivity will decrease. If a long path length is secured for the upper ejection path 517 alternatively, the apparatus will become larger.

Thus, in the example of FIG. 6, even if the upper sheet ejection processing is performed, when the sheet size is greater than a predetermined size (assumed to be A4 size), the lower ejection path 521 connected to the lower tray 537 is used rather than the upper ejection path 517 in the overlaying process.

The upper path flapper 518 is located at the second position before the start of sheet overlaying and switched to the first position before the operation of ejecting the overlaid sheets is started. Therefore, whenever the overlaid sheets are ejected, the upper path flapper 518 is switched, thereby increasing the frequency of occurrence of switching noise compared to the example of FIG. 4.

However, compared to the small-size sheets, large-size sheets involve long convey and processing time intervals, resulting in reduced productivity, and thus in a reduced switching frequency (but increased operating intervals) of the upper path flapper 518. This makes it possible to prevent the sheets from jumping out of the apparatus before the sheet overlaying process without particularly delaying the sheet convey speed and without making the apparatus larger although the effect of reduction in operating noise is not so good as in the case of the small-size sheets.

FIG. 7 is a timing chart of the upper sheet ejection processing performed by the sheet processing apparatus 500 with two A4-size sheets overlaid.

In FIG. 7, when a job to which the upper sheet ejection processing is specified is started, the upper ejection solenoid SL802 turns on (time T1) to switch the upper path flapper 518 to the first position, and consequently the conveyed sheet is led to the upper ejection path 517. When the first sheet is conveyed by a predetermined distance D1 after a time point (time T2) at which the first sheet is detected by the buffer sensor 508, the buffer motor M702 and the ejection motor M703 start deceleration. When the motors M702 and M703 stop, the buffer solenoid SL801 turns on (time T3), which causes the buffer flapper 507 to switch to the buffering position.

The motors M702 and M703 start reverse rotation after a lapse of a predetermined time t1 from when having stopped (time T4). Since the buffer solenoid SL801 is on and the buffer flapper 507 is at the buffering position, the sheet is led to the buffer path 540. When the sheet is conveyed by a predetermined distance D2 after a time point (time T5) at which the buffer sensor 508 turns off (no sheet), the buffer motor M702 starts deceleration.

When the buffer motor M702 stops, the sheet waits in the buffer path 540 and the buffer solenoid SL801 turns off to switch the buffer flapper 507 to the conveying position (time T6). The succeeding second sheet conveyed through the convey path 503 is led downstream. When the second sheet is conveyed by a predetermined distance D3 after the front edge of the second sheet is detected by the path sensor 506, the buffer motor M702 starts operating (time T7), and the first sheet and the second sheet are overlaid and led to the upper ejection path 517.

When the front edge of the bunch of the overlaid sheets is detected by the upper ejection sensor 509 (time T8), the ejection motor M703 decelerates after the sheets are conveyed by a predetermined distance D4 (time T9) and the sheets are ejected onto the upper tray 536.

Then, the operation described above is repeated for the succeeding sheets, and when the job is finished, the upper ejection solenoid SL802 turns off (time T10).

FIG. 8 is a timing chart of the upper sheet ejection processing performed by the sheet processing apparatus 500 with two A3-size sheets overlaid.

In FIG. 8, when the first sheet is detected by the buffer sensor 508 (time T12), after the sheet P1 is conveyed by a predetermined distance D11 therefrom, the buffer motor M702 starts deceleration. When the buffer motor M702 stops, the buffer solenoid SL801 turns on (time T13), which causes the buffer flapper 507 to switch to the buffering position.

The buffer motor M702 starts reverse rotation after a lapse of a predetermined time t11 from when having stopped (time T14). Since the buffer solenoid SL801 is on and the buffer flapper 507 is at the buffering position, the sheet is led to the buffer path 540. When the buffer sensor 508 turns off (no sheet), the upper ejection solenoid SL802 turns on to switch the upper path flapper 518 to the first position (time T15).

When the sheet is conveyed by a predetermined distance D12 after a time point (time T15) at which the buffer sensor 508 turns off (no sheet), the buffer motor M702 starts deceleration. When the buffer motor M702 stops, the sheet waits in the buffer path 540 and the buffer SL801 turns off to switch the buffer flapper 507 to the conveying position (time T16).

The succeeding second sheet conveyed through the convey path 503 is led downstream. Then, when the second sheet is conveyed by a predetermined distance D13 after the front edge of the second sheet is detected by the path sensor 506, the buffer motor M702 starts operating (time T17), and the first sheet and the second sheet are overlaid and led to the upper ejection path 517.

When the buffer sensor 508 turns off, the upper ejection solenoid SL802 turns off to switch the upper path flapper 518 to the second position (time T19). On the other hand, after the front edge of the bunch of the overlaid sheets is detected by the upper ejection sensor 509 (time T18), when the front edge of the sheet bunch is conveyed by a predetermined distance D14, the ejection motor M703 decelerates (time T20) and the sheet bunch is ejected onto the upper tray 536.

Further, the operation described above is repeated for the succeeding sheets. With a large size (A3 size), the upper path flapper 518 is switched whenever the overlaying process is performed.

Figure 9:
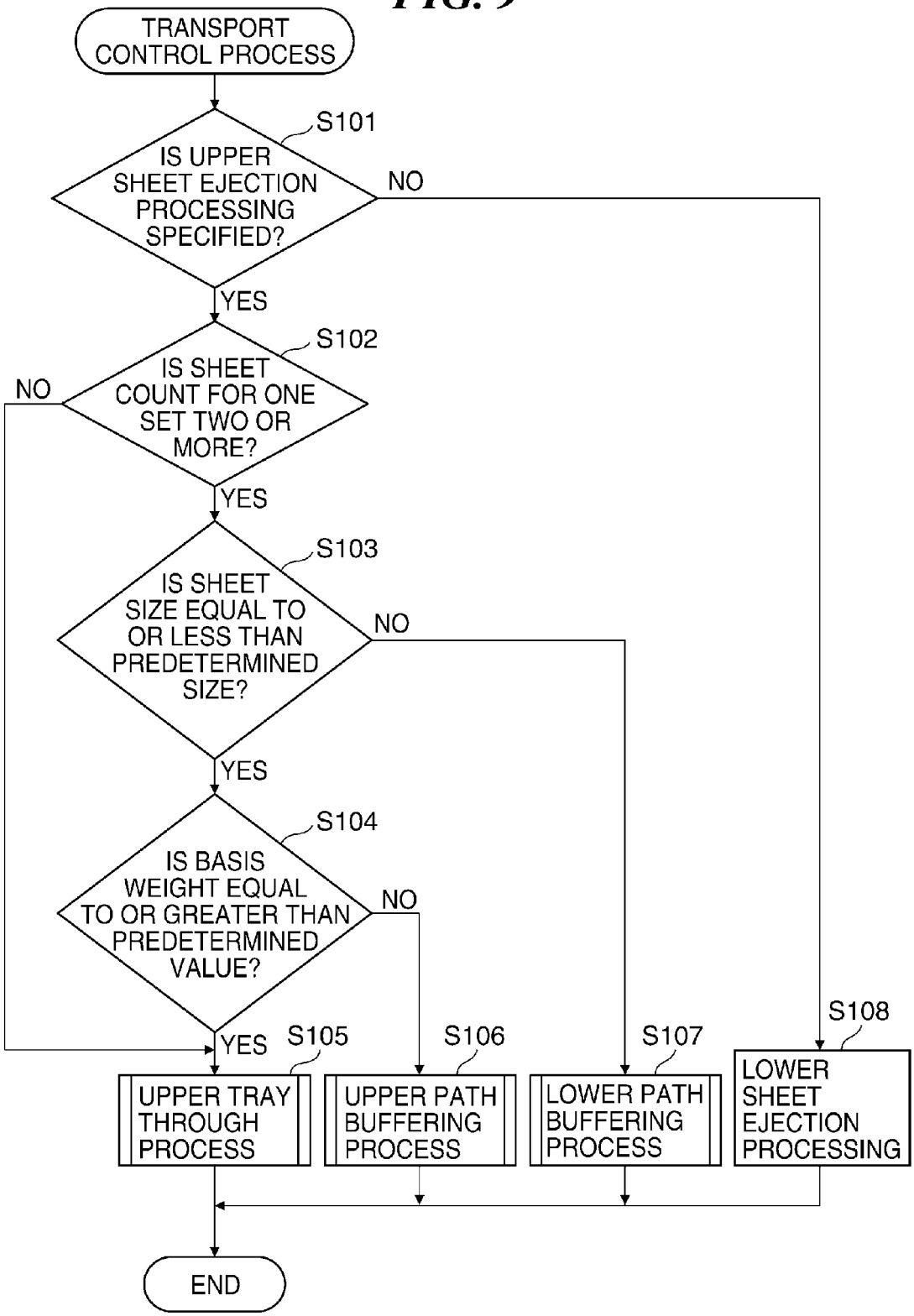
FIG. 9 is a flowchart showing the procedure of a convey control process that is performed by the sheet processing apparatus.

FIG. 9 is a flowchart showing the procedure of a convey control process performed by the finisher control section 553. This process is started when a job is inputted.

In FIG. 9, first, the finisher control section 553 determines whether or not the upper sheet ejection processing of ejecting the sheet onto the upper tray 536 is specified in the job (step S101). It should be noted that the finisher control section 553 may determine which of the upper sheet ejection processing and the lower sheet ejection processing is specified depending on whether or not the post-processing is specified for a plurality of sheets to be handled in the job. For example, it may be determined that the upper sheet ejection processing is specified when execution of the post-processing is not specified and that lower paper ejection is specified when execution of the post-processing is specified.

As a result of the determination, when the upper sheet ejection processing is not specified, it is supposed that the lower sheet ejection processing is specified, and hence the finisher control section 553 performs the lower sheet ejection processing (step S108), followed by the process of FIG. 9 terminating. The convey control shown in FIG. 4 by way of example is performed in the lower sheet ejection processing. Thus, the finisher control section 553 uses the lower ejection path 521 in the overlaying process and takes control so as to subject the sheets to necessary post-processing according to the job, and eject the sheets onto the lower tray 537.

On the other hand, if the upper sheet ejection processing is specified, the finisher control section 553 determines whether or not the number of sheets per one set to be processed in the job (sheet count for one set) is two or more (step S102). As a result of the determination, the sheet count for one set is less than two, the finisher control section 553 performs an upper tray through process (FIG. 10) (step S105), followed by the process of FIG. 9 terminating. The upper tray though process is to eject the conveyed sheets one by one onto the upper tray 536 without the overlaying process.

On the other hand, if the sheet count for one set is equal to or more than two, the finisher control section 553 determines whether or not the sheet size is equal to or less than a predetermined size (step S103). The predetermined size is assumed to be, for example, the A4 size, but this is not restrictive. As a result of the determination, the sheet size is greater than the predetermined size, the sheets to be processed are of a large size such as the A3 size, and hence the finisher control section 553 performs a lower path buffering process (FIG. 12) (step S107), followed by the process of FIG. 9 terminating.

As a result of the determination of the step S103, when the sheet size is equal to or smaller than the predetermined size, the sheets to be processed are of a small size such as the A4 size, and then the finisher control section 553 determines whether or not the basis weight of the sheet to be processed is equal to or greater than a predetermined value (step S104). Small-size and low-rigidity (poor strength) sheets, if ejected and stacked one by one, may result in reduced stackability. Thus, the predetermined value should be greater than a lower limit of the basis weight of the sheet such that there will be no problem even if the sheet is not overlaid on another sheet. The predetermined value is, for example, 80 g/m$^2$, but may not be limited thereto and may be changed according to the predetermined size used for determination of the step S103.

As a result of the determination, when the basis weight is equal to or greater than the predetermined value, the finisher control section 553 performs the upper tray through process (FIG. 10) (step S105), followed by the process of FIG. 9 terminating. On the other hand, if the basis weight is less than the predetermined value, the finisher control section 553 performs an upper path buffering process (FIG. 11) (step S106), followed by the process of FIG. 9 terminating.

Figure 10:
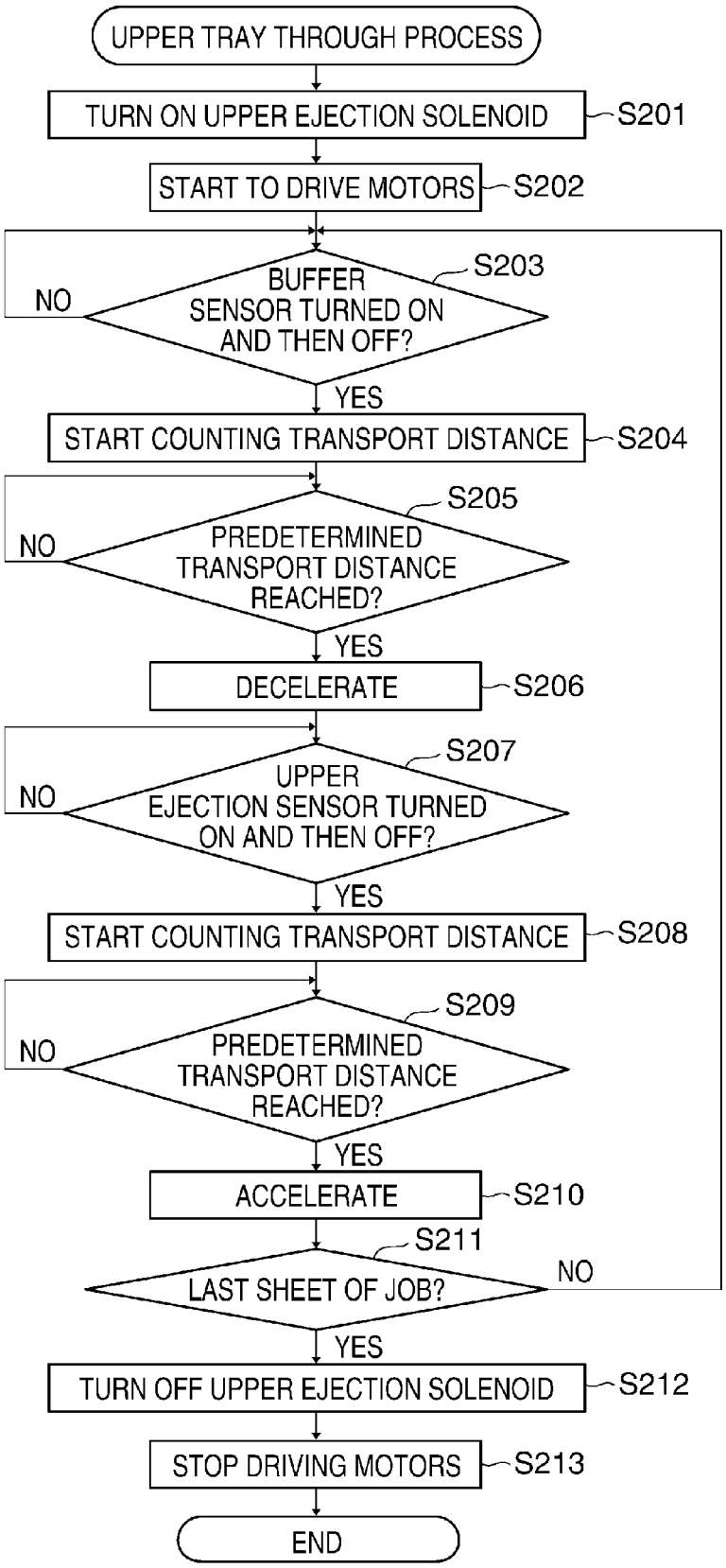
FIG. 10 is a flowchart showing the procedure of an upper tray through process that is performed at step S105 in FIG. 9.

FIG. 10 is a flowchart showing the procedure of the tray through process.

In FIG. 10, first, the finisher control section 553 turns on the upper ejection solenoid SL802 to switch the upper path flapper 518 to the first position (step S201), and starts driving the conveying motor M701, the buffer motor M702, and the ejection motor M703 (step S202). Next, the finisher control section 553 waits until the sheet is conveyed and the buffer sensor 508 turns on and then off (step S203). When the buffer sensor 508 turns off, i.e., when the rear edge of the sheet is detected, the finisher control section 553 starts counting the sheet convey distance based on a drive signal of the ejection motor M703 (step S204).

Next, the finisher control section 553 waits until the sheet convey distance reaches a predetermined value (step S205), and when the sheet convey distance reaches a predetermined value, the finisher control section 553 reduces the convey speed to a predetermined convey speed by controlling the ejection motor M703 (step S206).

Next, the finisher control section 553 waits until the upper ejection sensor 509 turns on and then off (step S207). When the upper ejection sensor 509 turns off, i.e., when the rear edge of the sheet is detected, the finisher control section 553 starts counting the sheet convey distance based on a drive signal of the ejection motor M703 (step S208).

Next, the finisher control section 553 waits until the sheet convey distance reaches a predetermined value (step S209), and when the sheet convey distance reaches a predetermined value, the finisher control section 553 increases the convey speed to a predetermined convey speed by controlling the ejection motor M703 (step S210).

Next, the finisher control section 553 determines whether or not the sheet conveyed this time is the last sheet of the job (step S211). If the sheet is not the last sheet, the finisher control section 553 returns to step S203. On the other hand, if the sheet conveyed this time is the last sheet of the job, the finisher control section 553 turns off the upper ejection SL802 and switches the upper path flapper 518 to the second position (step S212). Then, the finisher control section 553 stops driving the conveying motor M701, the buffer motor M702, and the ejection motor M703 (step S213).

FIG. 11 is a flowchart showing the procedure of the upper path buffering process. The process will be described with reference also to FIGS. 5 and 7.

In FIG. 11, first, the finisher control section 553 turns on the upper ejection solenoid SL802 (step S301) and switches the upper path flapper 518 to the first position (time T1 in FIG. 7). Next, the finisher control section 553 starts driving the conveying motor M701, the buffer motor M702, and the ejection motor M703 (step S302) (FIG. 5A).

The finisher control section 553 waits until the first sheet P1 is conveyed and the buffer sensor 508 turns on (step S303). When the buffer sensor 508 turns on (time T2 in FIG. 7), the finisher control section 553 starts counting the sheet convey distance based on a drive signal of the ejection motor M703 (step S304).

The finisher control section 553 waits until the sheet convey distance reaches a predetermined distance D1 (step S305), and when the sheet convey distance reaches the predetermined distance D1, the finisher control section 553 stops the ejection motor M703 and the buffer motor M702 (step S306). When the motors M702 and M703 stop, the sheet P1 stops at a switch-back position (at which the sheet is reversed) (FIG. 5B). Then the finisher control section 553 turns on the buffer solenoid SL801 (step S307) (time T3 in FIG. 7), which causes the buffer flapper 507 to switch to the buffering position.

The finisher control section 553 determines whether or not a predetermined time t1 has elapsed after the motors M702 and M703 has stopped (step S308). If the predetermined time t1 has elapsed, the finisher control section 553 reverses the buffer motor M702 and starts switch-back convey (step S309) (time T4 in FIG. 7). Since the buffer SL801 is on and the buffer flapper 507 is at the buffering position, the sheet P1 is led to the buffer path 540.

The finisher control section 553 waits until the buffer sensor 508 turns off (step S310). Then, the finisher control section 553 conveys the sheet P1 by a predetermined distance D2 after a time point (time T5 in FIG. 7) at which the buffer sensor 508 turns off, and then stops the buffer motor M702 (step S311) to thereby temporarily stop conveying the sheet P1 at a buffer wait position with the sheet P1 pinched by the first buffer roller pair 512 (FIG. 5C). Next, the finisher control section 553 switches the buffer flapper 507 to the conveying position by turning off the buffer solenoid SL801 (step S312) (time T6 in FIG. 7).

Figure 5E:
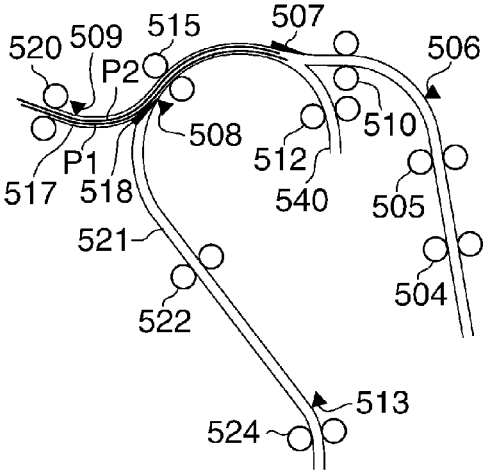

Next, the finisher control section 553 waits until a succeeding (second) sheet P2 is conveyed and the path sensor 506 is switched from off to on (step S313). When the path sensor 506 turns on, the finisher control section 553 starts counting the convey distance of the sheet P2 based on a drive signal of the conveying motor M701 (step S314). The finisher control section 553 waits until the sheet P2 is conveyed by a predetermined distance D3 (step S315), and when the sheet P2 is conveyed the predetermined distance D3, the finisher control section 553 starts driving the buffer motor M702 (step S316) (time T7 in FIG. 7). Consequently, the sheet P1 and the sheet P2 are overlaid and led to the upper ejection path 517 (FIGS. 5D and 5E).

Next, the finisher control section 553 waits until a sheet is conveyed and the buffer sensor 508 turns on and then off (step S317). After the buffer sensor 508 turns off, the finisher control section 553 performs processes similar to those in steps S204 to S213 of FIG. 10. However, in the step S211, when the sheets conveyed in a overlaid manner this time is not the last sheet of the job, the process returns to step S303.

FIG. 12 is a flowchart showing the procedure of the lower path buffering process. The process will be described with reference also to FIGS. 6 and 8.

In FIG. 12, first, the finisher control section 553 starts driving the conveying motor M701, the buffer motor M702, and the ejection motor M703 (step S401) (FIG. 6A).

The finisher control section 553 waits until the first sheet P1 is conveyed and the buffer sensor 508 turns on (step S402). When the buffer sensor 508 turns on (time T12 in FIG. 8), the finisher control section 553 starts counting the sheet convey distance based on a drive signal of the ejection motor M703 (step S403).

The finisher control section 553 waits until the sheet convey distance reaches a predetermined distance D11 (step S404). When the sheet convey distance reaches the predetermined distance D11, the finisher control section 553 stops the buffer motor M702 to thereby stop the sheet P1 at the switch-back position (step S405) (time T13 in FIG. 8) (FIG. 6B). Furthermore, the finisher control section 553 turns on the buffer solenoid SL801 to thereby switch the buffer flapper 507 to the buffering position (step S406).

Next, the finisher control section 553 determines whether or not a predetermined time t11 has elapsed after the buffer motor M702 has stopped (step S407). If the predetermined time t11 has elapsed, the finisher control section 553 reverses the buffer motor M702 and starts switch-back convey (step S408) (time T14 in FIG. 8). Since the buffer solenoid SL801 is on and the buffer flapper 507 is at the buffering position, the sheet P1 is led to the buffer path 540.

The finisher control section 553 waits until the buffer sensor 508 turns off (step S409). Then, when the buffer sensor 508 turns off, the finisher control section 553 turns on the upper ejection SL802 and switches the upper path flapper 518 to the first position (step S410) (time T15 in FIG. 8).

The finisher control section 553 conveys the sheet P1 by a predetermined distance D12 after the buffer sensor 508 has turned off, and then stops the buffer motor M702 (step S411) (time T16 in FIG. 8) to thereby temporarily stop conveying the sheet P1 at a buffer wait position with the sheet P1 pinched by the first buffer roller pair 512 (FIG. 6C). In so doing, the finisher control section 553 switches the buffer flapper 507 to the conveying position by turning off the buffer SL801.

Figure 6E:
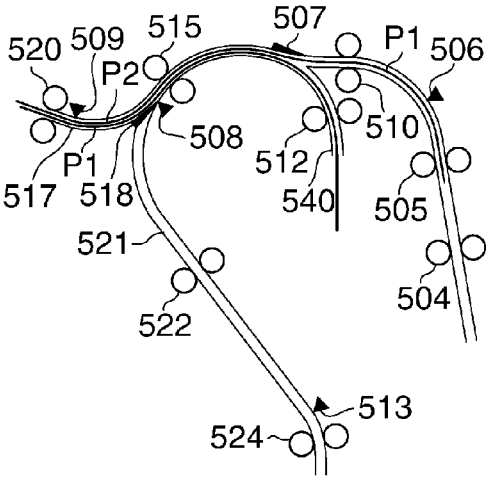

Next, the finisher control section 553 waits until a succeeding (second) sheet P2 is conveyed and the path sensor 506 is switched from off to on (step S413). When the path sensor 506 turns on, the finisher control section 553 starts counting the convey distance of the sheet P2 based on the drive signal of the conveying motor M701 (step S414). The finisher control section 553 waits until the sheet P2 is conveyed by a predetermined distance D13 (step S415), and when the sheet P2 is conveyed by the predetermined distance D13, the finisher control section 553 starts driving the buffer motor M702 (step S416), (time T17 in FIG. 8). Consequently, the sheet P1 and the sheet P2 are overlaid and led to the upper ejection path 517 (FIGS. 6D and 6E).

Next, the finisher control section 553 waits until the sheet is conveyed and the buffer sensor 508 turns on and then off (step S417). When the buffer sensor 508 turns off, the finisher control section 553 turns off the upper ejection solenoid SL802 and switches the upper path flapper 518 to the second position (step S412) (time T19 in FIG. 8).

Subsequently, the finisher control section 553 performs processes similar to those in steps S204 to S213 of FIG. 10. In step S211, when the sheets conveyed in a overlaid manner this time is not the last sheet of the job, the process returns to step S402.

According to the present embodiment, when the sheet processing apparatus 500 ejects a plurality of sheets in a overlaid manner onto the lower tray 537, the finisher control section 553 overlays the plurality of sheets using the lower ejection path 521 (lower sheet ejection processing; FIG. 4). On the other hand, when ejecting the plurality of sheets in a overlaid manner onto the upper tray 536, the finisher control section 553 overlays the plurality of sheets one on top of another using the upper ejection path 517 as a rule (upper path buffering process (FIG. 11)). This makes it possible to keep down the frequency of switching the upper path flapper 518, which reduces the switching frequency of the convey route to thereby control the noise.

However, even when the sheet processing apparatus 500 ejects the plurality of sheets in a overlaid manner onto the upper tray 536, sheets of a size greater than a predetermined size is subjected to the overlaying process using the lower ejection path 521 (lower path buffering process (FIG. 12)). This makes it possible to prevent the large sheets from jumping onto the upper tray 536 before overlaying.

Also, when the sheet processing apparatus 500 ejects a plurality of sheets onto the upper tray 536, if the sheets to be processed are equal to or less than a predetermined size and the basis weight of the sheets is less than a predetermined value, the overlaying process is performed using the upper ejection path 517 (upper path buffering process (FIG. 11)). Thus, even if the post-processing is not necessary, small-size and poor strength sheets can be ejected in a overlaid manner.

On the other hand, even if a plurality of sheets equal to or less than a predetermined size are to be processed in the job, if the basis weight is equal to or greater than a predetermined value, the sheets are ejected onto the upper tray 536 through the upper ejection path 517 without the overlaying process. This upper direct output process (FIG. 10) allows small-size sheets to be ejected without overlaying, provided the sheets have poor strength.

It should be noted that a case in which two sheets are overlaid in the overlaying process has been described so far by example. However, more than two sheets may be overlaid and can be overlaid by performing the above-mentioned switch-back and overlaying process repeatedly. For example, to convey three overlaid sheets, a succeeding, third sheet may be overlaid on two sheets overlaid earlier.

It should be noted that in the case of the upper sheet ejection processing, when the sheets to be processed in a job are overlaid with the sheets divided into a plurality of groups, the number of sheets overlaid in each group may be set to a fixed value such as two. Alternatively, the number of sheets to be overlaid may be specified by a user or may be determined automatically by the finisher control section 553 according to the total number of sheets to be processed in the job.

It should be noted that concrete processes of the post-processing performed in the sheet processing apparatus 500 are not limited to the processes described by example.

It should be noted that although it has been stated that the present invention is applied to the sheet processing apparatus 500 configured to be connected to the image forming apparatus 10 in such a way as to be able to communicate therewith, the present invention is applicable to any apparatus equipped with an image forming unit or configured integrally with the image forming apparatus 10, and called as an image forming apparatus as a whole.

Whereas the present invention has been described in detail with reference to an exemplary embodiment, the present invention is not limited to the specific embodiment described above and various other embodiments are included in the present invention without departing from the spirit and scope of the invention.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2014-142306 filed Jul. 10, 2014, which is hereby incorporated by reference herein in its entirety.

What is claimed is:

1. A sheet processing apparatus comprising:

a convey unit configured to convey a sheet;

a first stacking unit on which the sheet conveyed by the convey unit is stacked through a first convey path;

a second stacking unit on which the sheet conveyed by the convey unit is stacked through a second convey path;

a switching unit configured to switch between a first position at which the conveyed sheet is led to the first convey path, and a second position at which the conveyed sheet is led to the second convey path;

a buffer path, disposed at a location of upstream of the switching unit, into which the conveyed sheet once entering the first convey path or the second convey path and subsequently reversely conveyed is received; and a control unit configured to control the convey unit and the switching unit so as to perform a buffering process of overlaying the conveyed sheet conveyed from the buffer path and another sheet subsequently conveyed by the convey unit, wherein the control unit controls the convey unit and the switching unit such that the second convey path is used by the buffering process when the conveyed sheets to be received into the buffer path is ejected to the second stacking unit, and that the first convey path and not the second convey path is used by the buffering process when the conveyed sheet to be received into the buffer path is ejected to the first stacking unit.

2. The sheet processing apparatus according to claim 1, wherein the control unit maintains the switching unit at the second position until the last sheet of the conveyed sheets continuously ejected to the second stacking unit passes through the switching unit.

3. The sheet processing apparatus according to claim 1, wherein the control unit maintains the switching unit at the first position until the last sheet of the conveyed sheets continuously ejected to the first stacking unit passes through the switching unit.

4. The sheet processing apparatus according to claim 1, wherein said switching unit is switched to the second position in an initial state in which the switching unit does not receive a driving force.

5. The sheet processing apparatus according to claim 1, wherein the second convey path is longer than the first convey path, and the control unit controls the convey unit and the switching unit such that the second convey path is used when the conveyed sheets, to be overlaid by the buffering process, of a size greater than a predetermined size are ejected to the first stacking unit.

6. The sheet processing apparatus according to claim 5, wherein the control unit controls the convey unit and the switching unit such that the switching unit is switched to the second position before overlaying of the conveyed sheets is started, and is switched to the first positon before ejection of the overlaid sheets to the first stacking unit is started, when the conveyed sheets, to be overlaid by the buffering process, of a size greater than the predetermined size are ejected to the first stacking unit.

7. The sheet processing apparatus according to claim 1, wherein the control unit controls the convey unit and the switching unit such that the conveyed sheets overlaid by the buffering process are ejected to the first stacking unit, when the conveyed sheets, to be overlaid by the buffering process, are of a size equal to or less than a predetermined size and of a basis weight less than a predetermined basis weight.

8. The sheet processing apparatus according to claim 1, wherein the control unit controls the convey unit and the switching unit such that the conveyed sheet is ejected to the first stacking unit via the first convey path without the another sheet overlaid by the buffering process when the conveyed sheet and the another sheet, to be overlaid by the buffering process, are of a size equal to or less than a predetermined size and of a basis weight equal to or greater than a predetermined basis weight.

9. The sheet processing apparatus according to claim 1, further comprising a post-processing section disposed on a route connecting from the second convey path to the second stacking unit and configured to subject the overlaid sheets to post-processing.

10. An image forming apparatus comprising;

an image forming section configured to form an image on a sheet;

a convey unit configured to convey a sheet;

a first stacking unit on which the sheet conveyed by the convey unit is stacked through a first convey path;

a second stacking unit on which the sheet conveyed by the convey unit is stacked through a second convey path;

a switching unit configured to switch between a first position at which the conveyed sheet is led to the first convey path, and a second position at which the conveyed sheet is led to the second convey path;

a buffer path, disposed at a location of upstream of the switching unit, into which the conveyed sheet once entering the first convey path or the second convey path and subsequently reversely conveyed is received; and a control unit configured to control the convey unit and the switching unit so as to perform a buffering process of overlaying the conveyed sheet conveyed from the buffer path and another sheet subsequently conveyed by the convey unit, wherein the control unit controls the convey unit and the switching unit such that the second convey path is used by the buffering process when the conveyed sheets to be received into the buffer path is ejected to the second stacking unit, and that the first convey path and not the second convey path is used by the buffering process when the conveyed sheet to be received into the buffer path is ejected to the first stacking unit.

* * * * *